US008156855B2

(12) United States Patent
Anderson

(10) Patent No.: US 8,156,855 B2
(45) Date of Patent: Apr. 17, 2012

(54) FIREARM ATTACHABLE BULLET TRAP

(75) Inventor: Ian James Anderson, Kitchener (CA)

(73) Assignee: Colt Canada Corporation (CA)

( * ) Notice: Subject to any disclaimer, the term of this patent is extended or adjusted under 35 U.S.C. 154(b) by 329 days.

(21) Appl. No.: 12/436,464

(22) Filed: May 6, 2009

(65) Prior Publication Data

US 2010/0281747 A1 Nov. 11, 2010

(51) Int. Cl.
*F41A 21/00* (2006.01)

(52) U.S. Cl. ..... 89/14.05; 89/14.5; 273/410

(58) Field of Classification Search ..... 89/14.05, 89/14.4, 30; 181/223; 102/485; 273/410
See application file for complete search history.

(56) References Cited

U.S. PATENT DOCUMENTS 5,325,758 A * 7/1994 Compton et al. ..... 89/14.5
5,349,906 A * 9/1994 Devaux et al. ..... 102/485
5,983,772 A * 11/1999 Reynolds et al. ..... 89/29
6,176,032 B1 * 1/2001 Cohen et al. ..... 42/96
6,408,765 B1 * 6/2002 Tauber et al. ..... 102/499
6,688,032 B1 * 2/2004 Gonzalez et al. ..... 42/105
6,889,593 B2 * 5/2005 Guhring et al. ..... 89/14.5
7,380,363 B1 * 6/2008 Kirschner ..... 42/76.01
2011/0056364 A1 * 3/2011 Kennedy et al. ..... 89/14.05

FOREIGN PATENT DOCUMENTS

CA 2094048 10/1994

OTHER PUBLICATIONS

Canadian Intellectual Property Office, Office Action for CA Patent App. No. 2,665,565, Mar. 28, 2011.

* cited by examiner

*Primary Examiner* — Michael Carone
*Assistant Examiner* — Samir Abdosh
(74) *Attorney, Agent, or Firm* — Cantor Colburn LLP

(57) ABSTRACT

A firearm attachable bullet trap for use on a gas operated firearm having a compensator attached to the barrel. The bullet trap captures bullets from live rounds and provides an visual and tactile indication of live rounds having been fired. The bullet trap is designed for the shooting of blank rounds, but is adapted to handle live rounds having a bullet in a semi-automatic or automatic firearm.

19 Claims, 7 Drawing Sheets

FIREARM ATTACHABLE BULLET TRAP

FIELD OF THE INVENTION

The present invention relates generally to rifles or light machine guns. More particularly, the present invention relates to a firearm attachable bullet trap for stopping a bullet fired from a round in a rifle or light machine gun and dissipating the energy associated with the round.

BACKGROUND OF THE INVENTION

Canadian Patent 2,094,048 to Compton et al. (hereinafter Compton) teaches a blank firing attachment for use on a gas operated automatic rifle or light machine gun. The device restricts the exit of gases from the rifle barrel when a blank cartridge is filed, thus retaining sufficient gas pressure in the barrel to actuate the rifle's automatic firing mechanism and permit blank cartridges to be fired automatically or semi-automatically.

While the Compton device provides an essential function in allowing blank rounds, such as type C79A1 blank rounds, to be fired automatically or semi-automatically, it is not designed to stop ball rounds, such as NATO standard C77 type ball rounds.

It is, therefore, desirable to provide a firearm attachable bullet trap to stop at least one ball type round fired from a rifle to substantially prevent the bullet from exiting the rifle.

SUMMARY OF THE INVENTION

The present invention is directed to obviating or mitigating at least one disadvantage of previous firearm attachable bullet traps.

The firearm attachable bullet trap attaches to the firearm and functions normally as a blank firing attachment (BFA). In the event a ball round is fired, the firearm attachable bullet trap is designed to prevent the exit of the bullet and prevent injury to personnel by slowing, destructing, and preventing the bullet from exiting the rifle.

In one aspect of the invention, there is provided a bullet trap for use on a gas operated firearm having a compensator attached to the barrel, having a body adapted to engage said compensator, a spigot attached to said body, the spigot having a spigot bore extending therethrough, a ballistic plate chamber proximate the end of the spigot, distal said compensator, the ballistic plate chamber housing a ballistic plate, a bullet trap chamber, and a bullet trap orifice extending between the ballistic plate chamber and the bullet chamber, and at least one gas track extending between the ballistic plate chamber and the atmosphere, wherein the firearm attachable bullet trap is adapted to operate as a blank firing attachment with blank rounds and as a bullet trap with ball rounds.

In one embodiment, the spigot bore has a solid end, distal said compensator.

In one embodiment, the ballistic plate is adapted to move between a ready position and an impacted position when a bullet impacts upon the ballistic plate.

In one embodiment, the ballistic plate is adapted to substantially seal off the bullet trap orifice when in the ready position and substantially open the bullet trap orifice when in the impacted position. In one embodiment, the ballistic plate adapted to substantially seal off the at least one gas track when in the ready position and substantially open the at least one gas track when in the impacted position.

In one embodiment, the bullet trap of claim has an impact indicator operatively connected with the ballistic plate, the impact indicator adapted to provide both visual and tactile indication of when the ballistic plate has received the impact of a bullet.

In one embodiment, the spigot bore reducing in diameter through a plurality of steps. In one embodiment, said plurality of steps comprising three.

In one embodiment, said at least one gas track comprising two.

In one embodiment, the spigot is threadably movable relative to the body.

In one embodiment, the ballistic plate comprising armour plating.

In one embodiment the bullet trap having a gas escape connected to a bullet trap chamber, the gas escape adapted to diffuse gas and particles away from the line of fire as well as reduce velocity.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures, wherein.

DETAILED DESCRIPTION

Generally, the present invention provides a firearm attachable bullet trap for slowing, destructing, and preventing a bullet from exiting a rifle.

Figure 1:
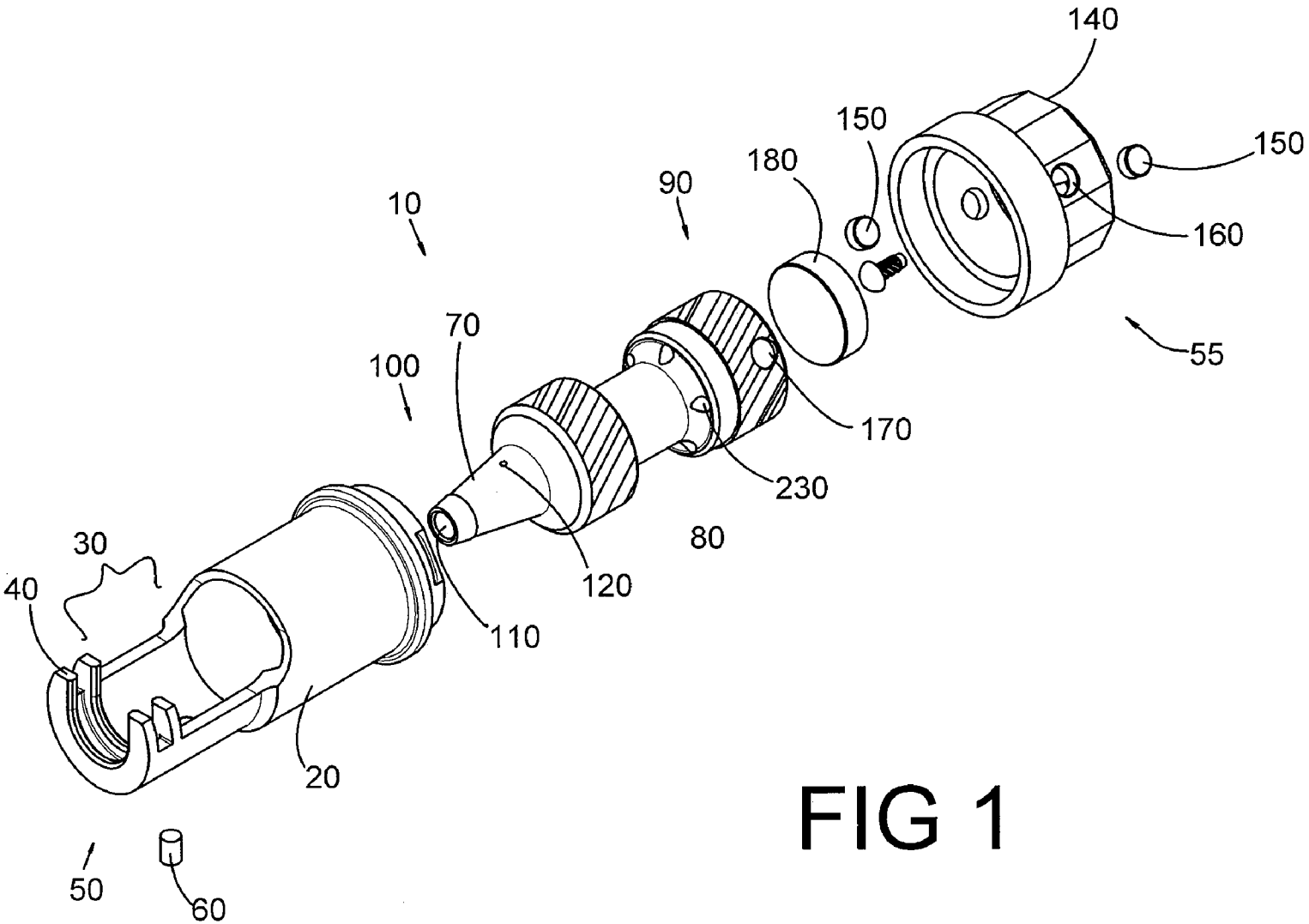
FIG. 1 is an exploded view of a firearm attachable bullet trap in an embodiment of the present invention.
Figure 2:
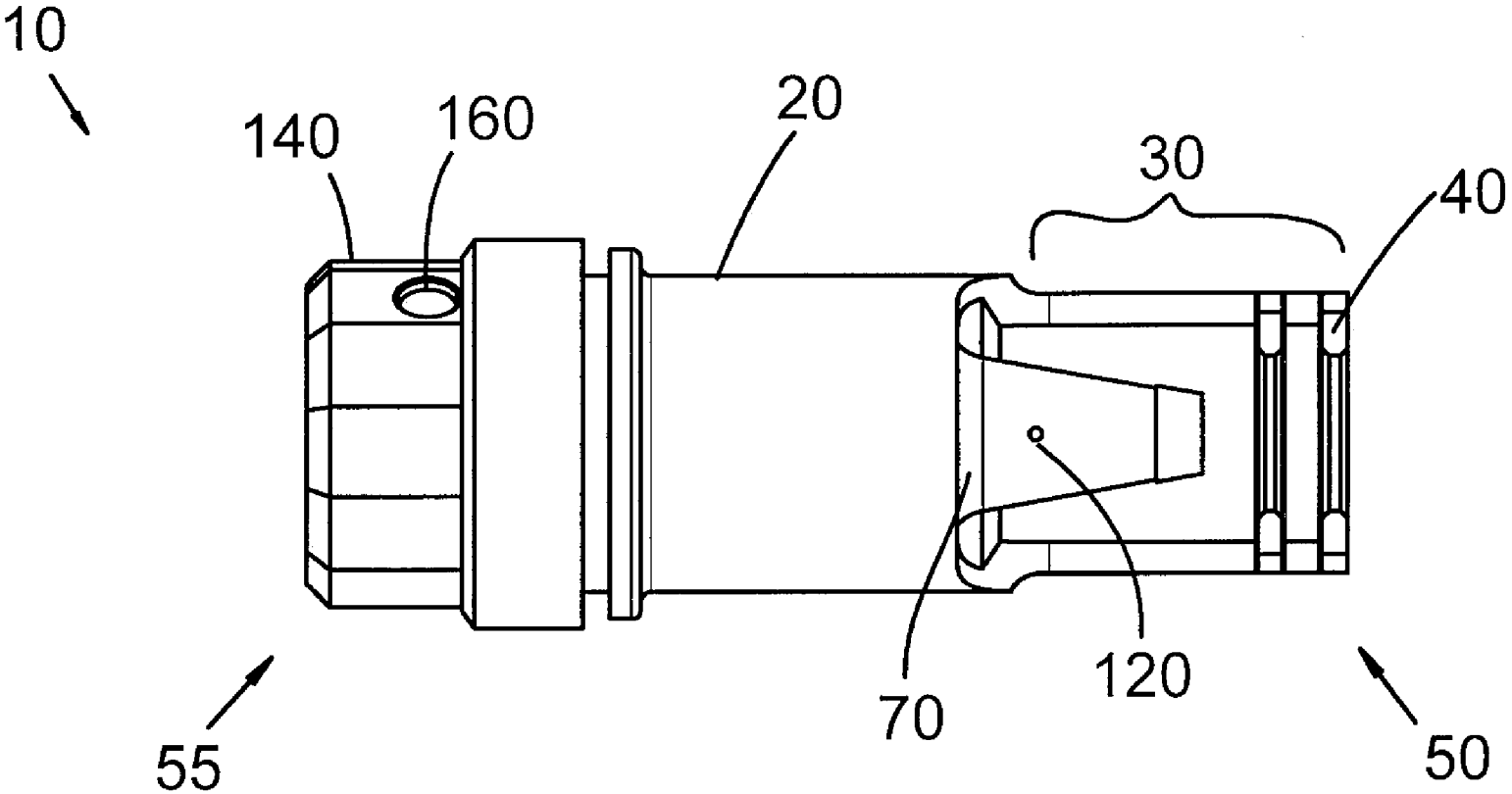
FIG. 2 is a bottom view of the firearm attachable bullet trap of FIG. 1.
Figure 3:
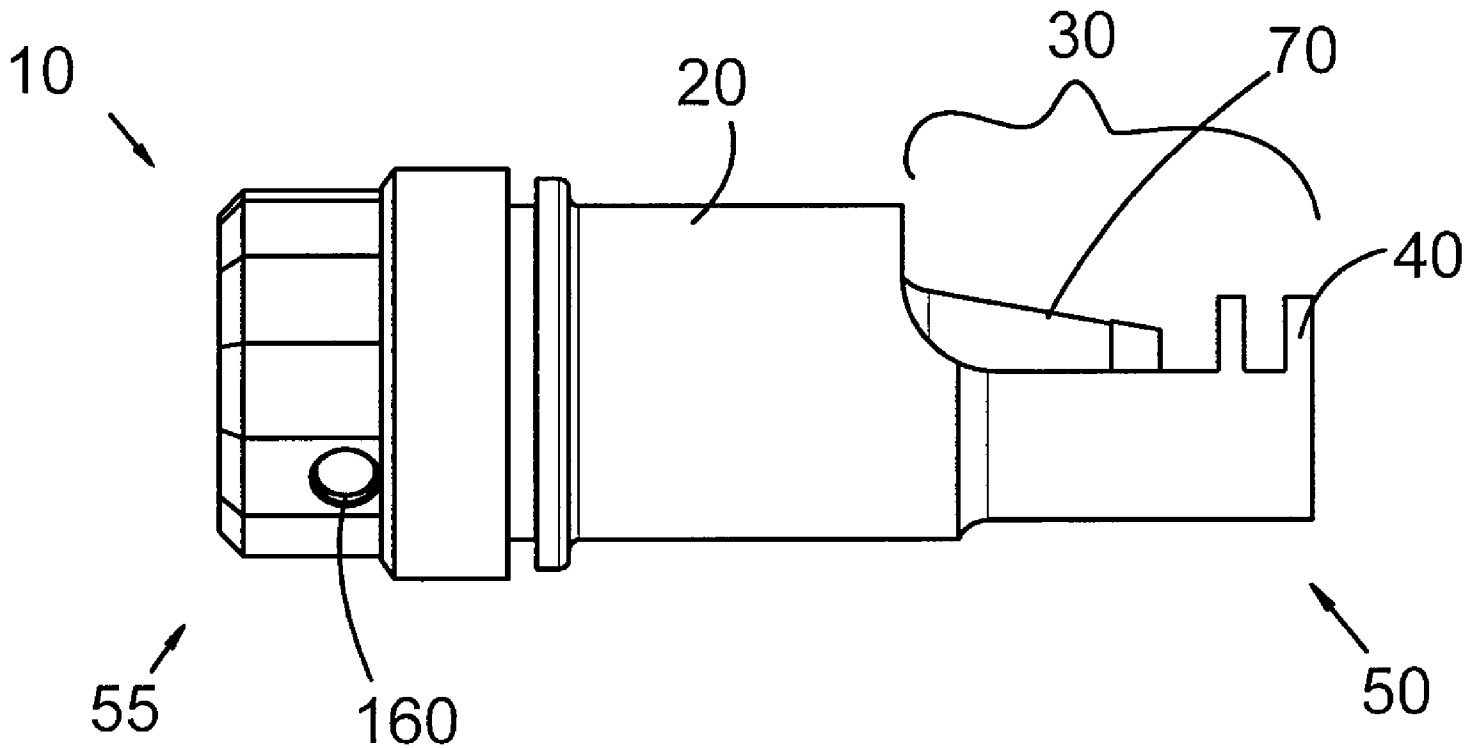
FIG. 3 is a side view of the firearm attachable bullet trap of FIG. 1.
Figure 5:
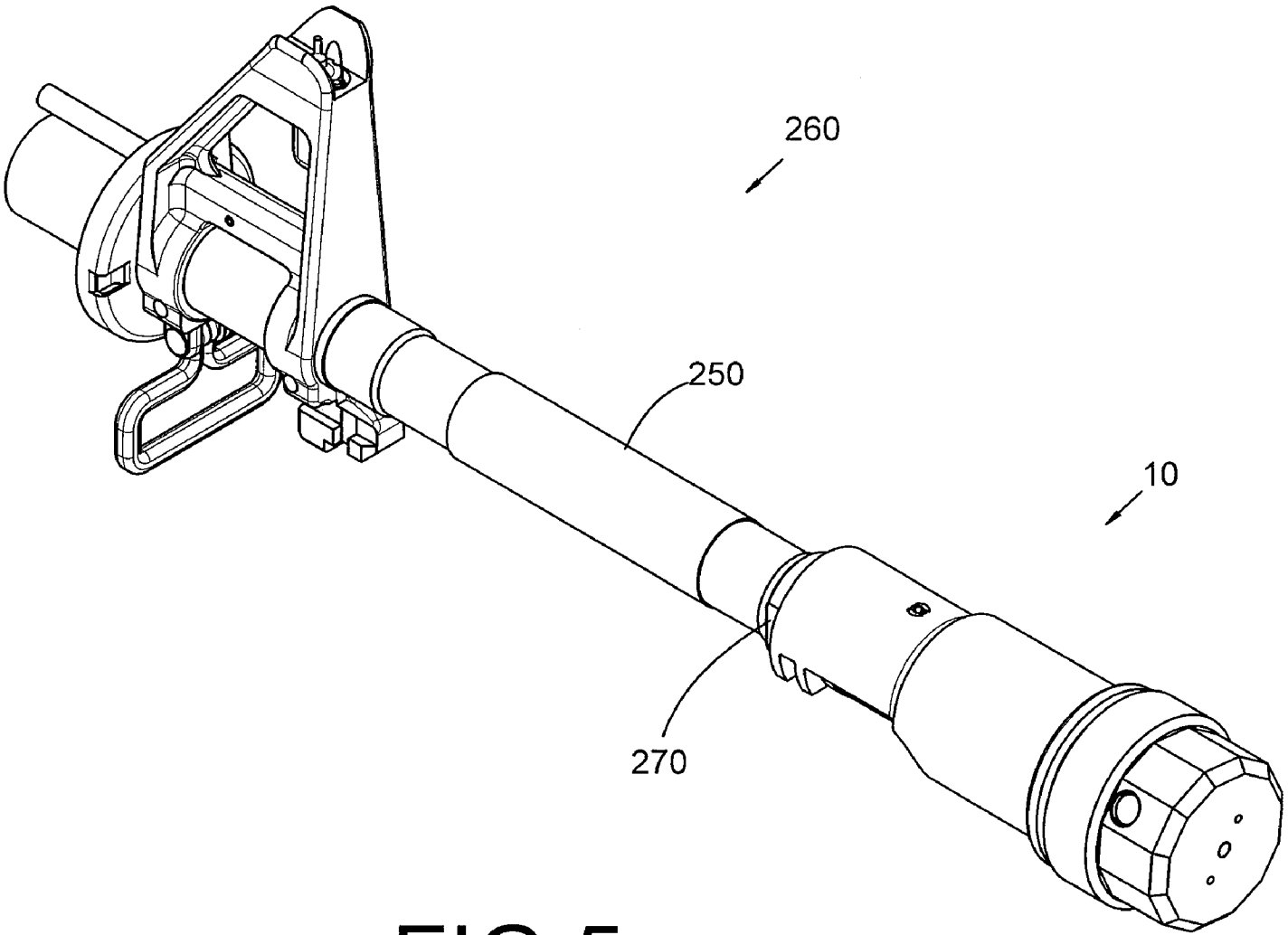
FIG. 5 is a perspective view of the firearm attachable bullet trap of FIG. 1 mounted to a rifle.
Figure 6:
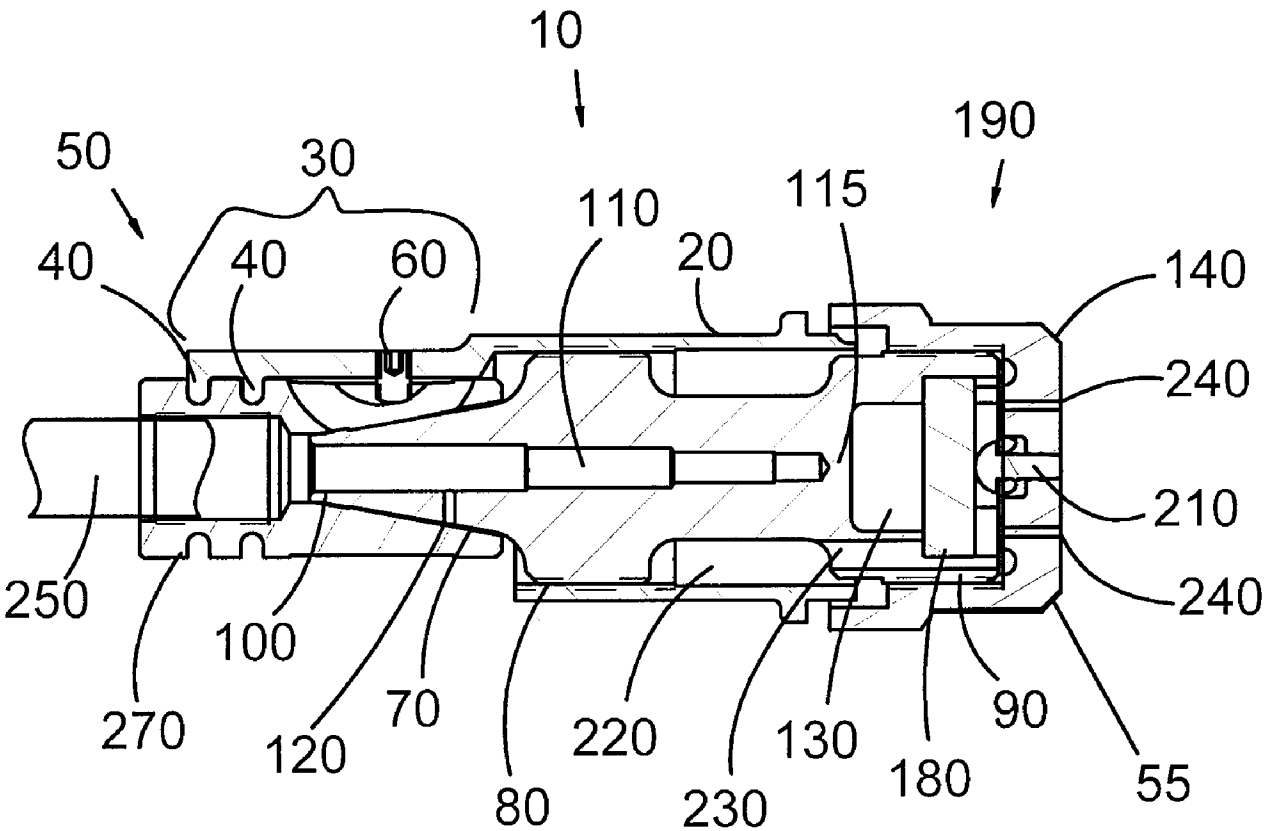
FIG. 6 is a sectional view of the firearm attachable bullet trap of FIG. 5, shown in a ready position.
Figure 7:
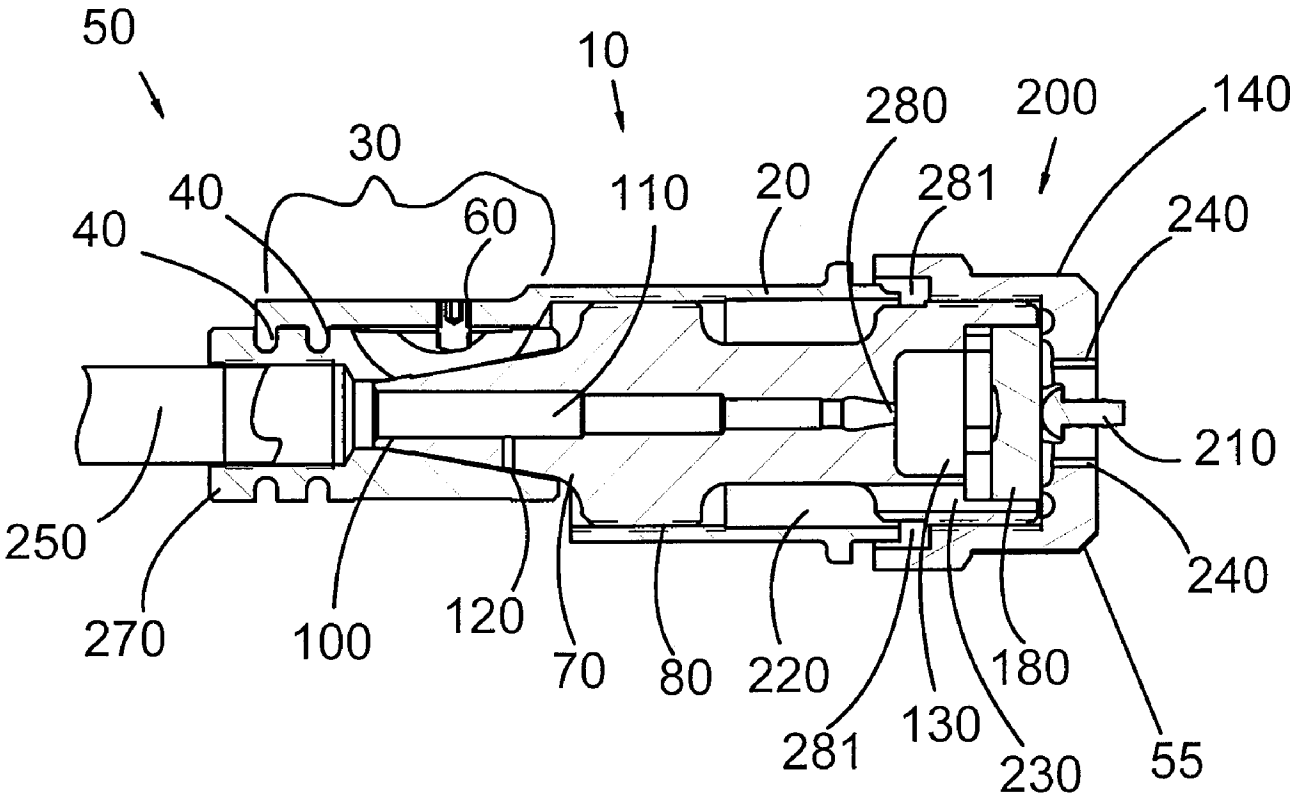
FIG. 7 is a sectional view of the firearm attachable bullet trap of FIG. 5, shown in an impacted position.

Referring to FIGS. 1-3, the firearm attachable bullet trap 10 includes a body 20 adapted to attach to a firearm 260 (see FIGS. 5-7). The body 20 has an attachment portion 30 with a flange 40 proximate a rear end 50 of the body 20, the flange 40 adapted to engage a compensator 270 (see FIGS. 6-7) to secure the firearm attachable bullet trap 10 to barrel 250. A set screw 60 provides for adjustment of the connection fit.

A spigot 70 is received within and attached to the body 20. Threads 80 may engage the body 20 to threadably secure the spigot 70 within the body 20. The spigot 70 has a front end 90, a rear end 100, and a reducing cross-section spigot bore 110 extending from the rear end 100 toward the front end 90. The spigot bore terminates at a solid end 115 near the front end 90 (see FIG. 4). The rear end 100 of the spigot 70 is adapted to sealingly engage the compensator 270 (see FIGS. 6-7). The spigot 70 also has a blank firing attachment (BFA) orifice 120 extending between the spigot bore 110 and atmosphere.

A ballistic plate chamber 130 is formed at the front end 90 of the spigot 70 closed by a front cap 140. The front cap 140 and the spigot 70 are sealingly connected. In one embodiment a plug 150 extends through a plug channel 160 through a portion of the front cap 140 into a plug recess 170 and welded in place, but one ordinarily skilled in the art recognizes that there are many alternative means for making the connections.

Figure 4:
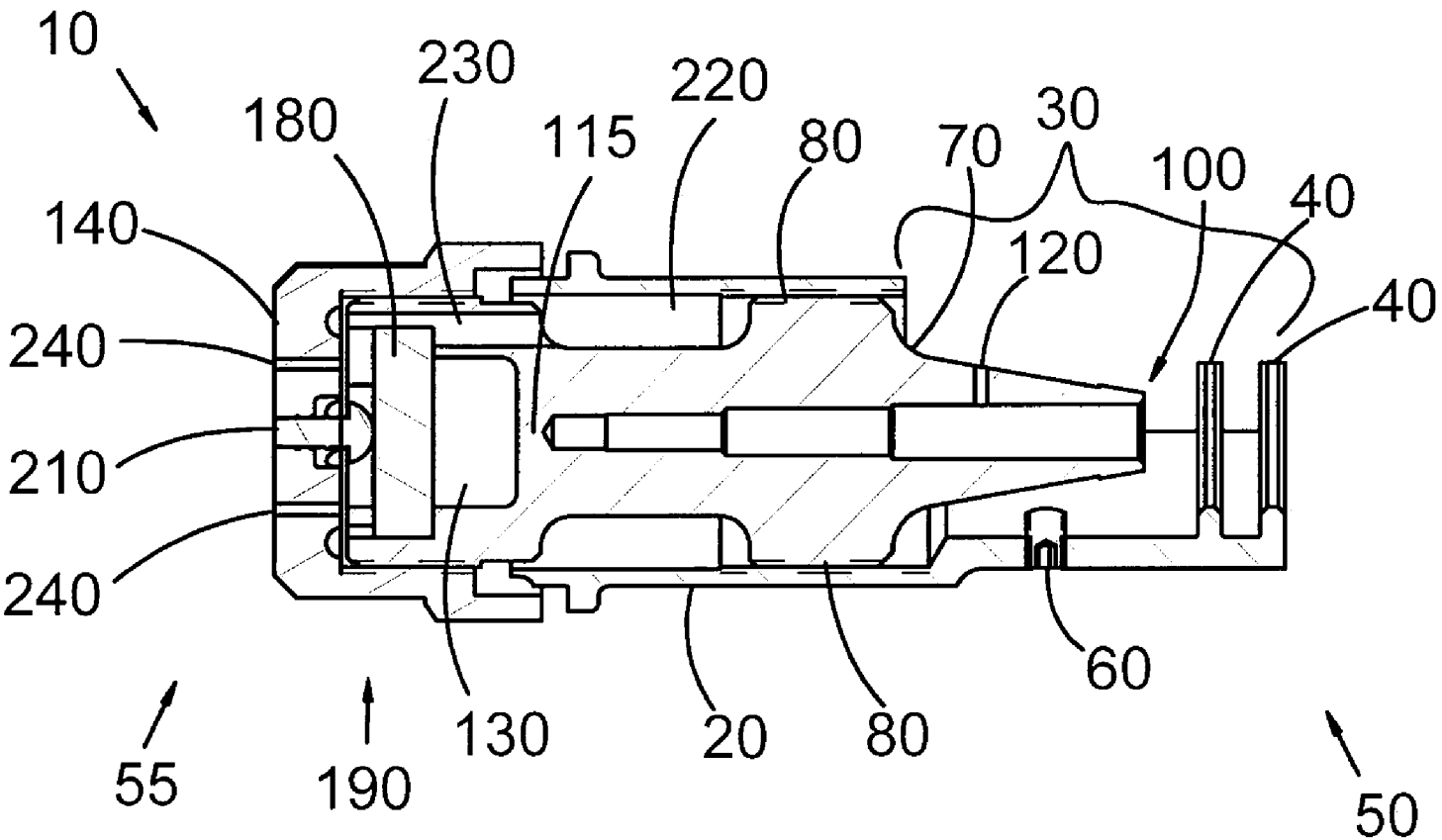
FIG. 4 is a sectional view of the firearm attachable bullet trap of FIG. 1.

A ballistic plate 180 is movably retained in the ballistic plate chamber 130 (see also FIGS. 4, and 6-7 and the associated description for additional details).

Referring to FIG. 4, the firearm attachable bullet trap 10. The ballistic plate 180 is movable between a ready position 190 (FIGS. 4 and 6), and an impacted position 200 (FIG. 7) within the ballistic plate chamber formed within the spigot 70 and the closed by the front cap 140. The ballistic plate 180 is axially aligned with the spigot bore 110. An impact indicator 210 is operatively connected with the ballistic plate 180, and the impact indicator 210 is adapted to provide visual and tactile indication of when the ballistic plate 180 has received the impact of bullets, such as in the impacted position 200 or somewhere in-between.

A bullet trap chamber 220 is provided within the body 20, for example as an annular space between the spigot 70 and the body 20, and provides for secondary gas expansion and material storage chamber. A bullet trap orifice 230 extends between the ballistic plate chamber 130 and the bullet trap chamber 220. The bullet trap orifice 230 is sealed off by the ballistic plate 180 when the ballistic plate 180 is in the ready position 190 and the bullet trap orifice 230 is opened when the ballistic plate 180 is not in the ready position 190 (for example the impacted position 200 or somewhere in-between), providing a connection between the bullet trap chamber 220 and the ballistic plate chamber 130. In the embodiment shown, there are six (6) bullet trap orifices 230.

At least one gas track 240 extends between the ballistic plate chamber 130 and the atmosphere. The at least one gas track 240 is sealed off by the ballistic plate 180 when the ballistic plate 180 is in the ready position 190 and the at least one gas track 240 is opened when the ballistic plate 180 has received the impact of at least one bullet (for example, the impacted position 200 or somewhere in-between), providing a fluid connection between the ballistic plate chamber 130 and the atmosphere. In the embodiment shown, there are two (2) gas tracks 240.

As shown, the cross-sectional area of the spigot bore 110 reduces from the rear end 100 towards the front end 90. The cross-sectional area may reduce stepwise by a reduction in diameter.

Referring to FIG. 5, the firearm attachable bullet trap 10 is shown attached to the barrel 250 of a firearm 260. One ordinarily skilled in the art understands the types of firearms 260 that the firearm attachable bullet trap 10 of the present invention are applicable, for example but not limited to a C9A1 light machine gun (LMG) or one of the many other types. The types of rifles that the firearm attachable bullet trap 10 of the present invention are designed to be used with generally include a compensator/flash hider 270 attached to the end of the barrel 250. In this document, any reference to compensator is used for convenience and includes a compensator, flash hider or other attachment at the end of the barrel 250, or direct attachment to the barrel 250.

Referring to FIG. 6, the firearm attachable bullet trap 10 is shown in the ready position 190, attached to the compensator/flash hider 270 of the gun barrel 250. The only fluid path for gases from the barrel 250 is through a portion of the spigot bore 110 and out the BFA orifice 120 to atmosphere.

Referring to FIG. 7, the firearm attachable bullet trap 10 is shown in the impacted position 200, attached to the compensator/flash hider 270 of the gun barrel 250. A bullet has travelled through the spigot bore 110 and broken through the solid end 115, and impacted upon the ballistic plate 180 (pushing it from the ready position 190 into the impacted position 200). When the ballistic plate 180 is moved, the BT orifice 230 and the gas tracks 240 are opened, and the impact indicator 210 provides a visual and tactile indication.

In operation (referring to FIGS. 6 and 7) the firearm attachable bullet trap 10 functions as a normal blank firing attachment (BFA) until a ball round is fired in the rifle. The firearm attachable bullet trap 10 employs stages to slow, destruct and prevent bullets from exiting the rifle.

The spigot bore 110 is closed by the solid end 115, which results in the bullet compressing the column of air ahead of it in the spigot bore 110. The only exit for the air is the relatively small BFA orifice 120.

As the bullet enters the spigot bore 110, the bullet encounters a plurality of diameter reductions that first strip the bullet of its jacket, then compress the steel penetrator and lead pusher into progressively smaller diameter projectiles and slow their forward momentum.

The separated bullet pieces then engage the solid end 115 of the spigot bore 110. The solid end 115 is penetrated, forming an open end 280 where the solid end 115 was, and the bullet fragments enter the ballistic plate chamber 130. The penetration of the solid end 115 occurs only on the first ball round. Once the solid end 115 is penetrated, the firearm attachable bullet trap will no longer provide sufficient backpressure, and the rifle will not be able to fire blank rounds in automatic or semiautomatic mode.

The bullet fragments push the ballistic plate 180 from the ready position 190 into the impacted position 200 which opens the BT orifices 230 allowing flow of gases and bullet pieces into the bullet trap chamber 220. The movement of the ballistic plate 180 into the impacted position 200 also opens the gas tracks 240 allowing escape of gas out the front end cap 55 and the body 20 while blocking bullet material exit from the gas tracks 240.

The column of high pressure gas behind the bullet moves a substantial amount of the bullet fragments into the bullet trap chamber 220 and the ballistic plate chamber 130. The escape of gas and minute bullet fragments is forced to exit via a gas escape, shown as feature 281. In one embodiment gas escape 281 takes the form of an "S". Gas escape 281 is formed by the front of the body 20 and the rear of the cap 55. This feature diffuses the escaping gases and reduces fragment size and velocity.

In the preceding description, for purposes of explanation, numerous details are set forth in order to provide a thorough understanding of the embodiments of the invention. However, it will be apparent to one skilled in the art that these specific details are not required in order to practice the invention.

The above-described embodiments of the invention are intended to be examples only. Alterations, modifications and variations can be effected to the particular embodiments by those of skill in the art without departing from the scope of the invention, which is defined solely by the claims appended hereto.

What is claimed is:

1. A bullet trap for use on a gas operated firearm having a compensator attached to a barrel, the bullet trap comprising:

a body for engaging said compensator;

a spigot attached to said body, the spigot having a spigot bore extending from a rear end towards a front end;

a ballistic plate chamber proximate the front end of the spigot, distal said compensator, the ballistic plate chamber housing a ballistic plate;

a bullet trap chamber, and at least one bullet trap orifice extending between the ballistic plate chamber and the bullet chamber;

at least one gas track extending between the ballistic plate chamber and the atmosphere; and an impact indicator operatively connected with the ballistic plate, the impact indicator provides visual and tactile indications of when the ballistic plate has received the impact of a bullet, wherein the firearm attachable bullet trap operates as a blank firing attachment with blank rounds and as a bullet trap with ball rounds.

2. The bullet trap of claim 1, wherein the spigot bore further comprising a solid end, distal said compensator.

3. The bullet trap of claim 1, wherein the ballistic plate moves between a ready position and an impacted position when a bullet impacts upon the ballistic plate.

4. The bullet trap of claim 3, wherein the ballistic plate substantially seals off the bullet trap orifice when in the ready position and substantially opens the bullet trap orifice when in the impacted position.

5. The bullet trap of claim 3, wherein the ballistic plate substantially seals off the at least one gas track when in the ready position and substantially opens the at least one gas track when in the impacted position.

6. The bullet trap of claim 1, wherein the spigot bore reduces in diameter through a plurality of steps.

7. The bullet trap of claim 6, wherein said plurality of steps comprises three steps, whereby at least two steps have a diameter less than a diameter of the bullet.

8. The bullet trap of claim 1, wherein said at least one gas track comprises two gas tracks.

9. The bullet trap of claim 1, wherein the spigot is threadably movable relative to the body.

10. The bullet trap of claim 1 comprising a gas escape connected to said bullet trap chamber, said gas escape diffuses gas and particles away from the line of fire as well as reduces velocity.

11. The bullet trap of claim 10 wherein the gas escape is an S-shaped gas escape around the circumference of the bullet trap.

12. The bullet trap of claim 7 wherein the three steps comprise:

a first step designed to strip the bullet of a bullet jacket;

a second step designed to separate material from the bullet and compress steel penetrator; and a third step designed to further reduce the diameter, mass and velocity of projectiles.

13. A bullet trap for use on a gas operated firearm having a compensator attached to a barrel, comprising:

a body for engaging said compensator;

a spigot attached to said body, the spigot having a spigot bore extending from a rear end towards a front end;

a ballistic plate chamber proximate the front end of the spigot, distal said compensator, the ballistic plate chamber housing a ballistic plate;

a bullet trap chamber, and at least one bullet trap orifice extending between the ballistic plate chamber and the bullet chamber;

at least one gas track extending between the ballistic plate chamber and the atmosphere; and a gas escape connected to said bullet trap chamber, the gas escape diffuses gas and particles away from the line of fire as well as reduces velocity, wherein the firearm attachable bullet trap operates as a blank firing attachment with blank rounds and as a bullet trap with ball rounds;

further comprising an impact indicator operatively connected with the ballistic plate, the impact indicator provides visual and tactile indications of when the ballistic plate has received the impact of a bullet.

14. The bullet trap of claim 13 wherein the spigot bore reduces in diameter through three steps, the three steps comprising:

a first step designed to strip the bullet of a bullet jacket;

a second step designed to separate material from the bullet and compress steel penetrator; and a third step designed to further reduce the diameter, mass and velocity of projectiles.

15. The bullet trap of claim 13 wherein the gas escape is an S-shaped gas escape around the circumference of the bullet trap.

16. A method for trapping a bullet from a gas operated firearm having a compensator attached to a barrel, the method comprising:

receiving the bullet through a bore extending from a rear end towards a front end of a spigot of a bullet trap;

reducing the velocity and compressing particulates of the bullet through the bore;

creating impact with a ballistic plate housed within a ballistic plate chamber proximate to the front end of the spigot;

visually and tactily indicating the impact of the bullet when the bullet has been received by the ballistic plate;

venting through at least one bullet trap orifice to a bullet trap chamber, via a gas track extending between the ballistic plate and the atmosphere, gas and particulates created from the impact of the bullet against the ballistic plate;

storing some of the bullet material in the bullet trap chamber; and diffusing remaining gas and particulates through a gas escape.

17. The method of claim 16, wherein creating impact with the ballistic plate moves the plate from a ready position to an impacted position.

18. The method of claim 16, wherein the bore for receiving the bullet reduces in diameter through three steps, the three steps comprising:

a first step designed to strip the bullet of a bullet jacket;

a second step designed to separate material from the bullet and compress steel penetrator; and a third step designed to further reduce the diameter, mass and velocity of projectiles.

19. The method of claim 16 wherein diffusing remaining gases and particulates comprises forcing the gas and escaping particulates through an S-shaped gas escape around the circumference of the bullet trap.

* * * * *